US006863430B2

(12) United States Patent
Berube

(10) Patent No.: US 6,863,430 B2
(45) Date of Patent: Mar. 8, 2005

(54) MIXING ROD

(76) Inventor: George A. Berube, 133 Yorba St., Tustin, CA (US) 92780

( * ) Notice: Subject to any disclaimer, the term of this patent is extended or adjusted under 35 U.S.C. 154(b) by 0 days.

(21) Appl. No.: 10/414,338

(22) Filed: Apr. 16, 2003

(65) Prior Publication Data

US 2003/0202420 A1 Oct. 30, 2003

Related U.S. Application Data

(60) Provisional application No. 60/374,755, filed on Apr. 24, 2002.

(51) Int. Cl.[7] ..... B01F 7/16

(52) U.S. Cl. ..... 366/129; 366/343; 366/605

(58) Field of Search ..... 366/129, 248, 366/342, 343, 605; 416/69, 70 R; 15/141.1; D7/300.2, 376, 688; D8/70

(56) References Cited

U.S. PATENT DOCUMENTS

| | | | | | |
|---|---|---|---|---|---|
| 793,844 | A | * | 7/1905 | Libbman | 366/331 |
| 843,136 | A | * | 2/1907 | Dicks | 366/248 |
| 2,073,925 | A | * | 3/1937 | Farrington | 366/248 |
| 2,490,015 | A | * | 12/1949 | Carman | 426/238 |
| 2,505,967 | A | * | 5/1950 | Humphrey | 366/248 |
| 2,736,536 | A | * | 2/1956 | Banowitz | 366/248 |
| 2,905,453 | A | * | 9/1959 | Wise | 416/176 |
| 3,411,756 | A | * | 11/1968 | Ziegler | 366/251 |
| 3,704,007 | A | * | 11/1972 | Kroeger | 366/248 |
| 3,894,723 | A | * | 7/1975 | Sanders et al. | 366/248 |
| 4,049,243 | A | * | 9/1977 | Kramer | 366/98 |
| 4,422,770 | A | * | 12/1983 | Geible | 366/248 |
| 4,693,610 | A | * | 9/1987 | Weiss | 366/146 |
| 4,763,567 | A | * | 8/1988 | Dalquist et al. | 99/323.5 |
| D306,685 | S | * | 3/1990 | Nadeau | D8/70 |
| 5,403,091 | A | * | 4/1995 | Thomas | 366/279 |
| 5,417,493 | A | * | 5/1995 | Ericson | 366/343 |
| D419,414 | S | * | 1/2000 | Pellak | D8/70 |
| D440,476 | S | * | 4/2001 | Del Gaone | D8/70 |
| 2003/0202420 | A1 | * | 10/2003 | Berube | 366/129 |

FOREIGN PATENT DOCUMENTS

| | | | |
|---|---|---|---|
| DE | 2031349 | * | 6/1970 |
| DE | 2727814 | * | 1/1979 |
| DE | 3117459 | * | 11/1982 |
| GB | 2094167 | * | 9/1982 |

* cited by examiner

*Primary Examiner*—Charles E. Cooley
(74) *Attorney, Agent, or Firm*—Roger A. Marrs

(57) ABSTRACT

A mixing rod of an integral metal construction from a single piece provides a unitary unit having a power chuck engaging attachment end and a stirring end. The stirring end includes a pair of lobes defined by rod segments integral with an elongated shaft, wherein the lobes outwardly project 180° from one another. Each of the respective lobes terminates at its outer ends with rounded corners and a lower terminating segment joins the opposite lobes together. The lobes have height which insures that a substantial portion of the product being stirred will be engaged by the lobes in order to develop a proper product flow insuring efficient and proper mixture.

2 Claims, 2 Drawing Sheets

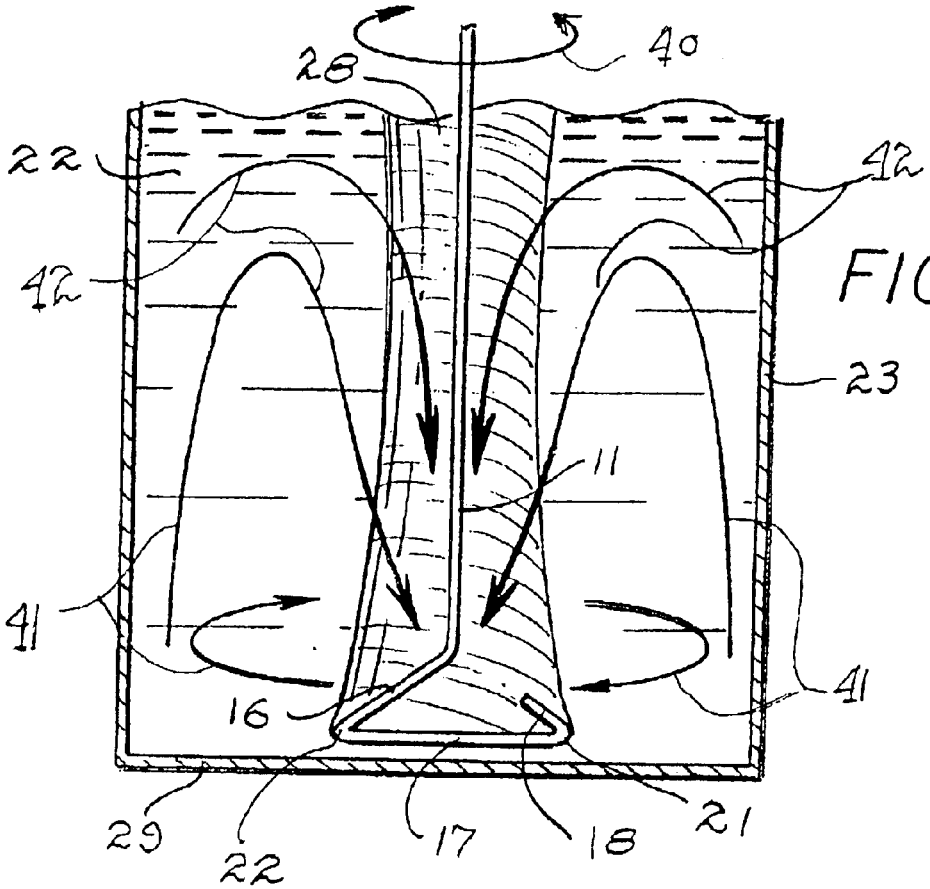
FIG. 3
FIG. 4
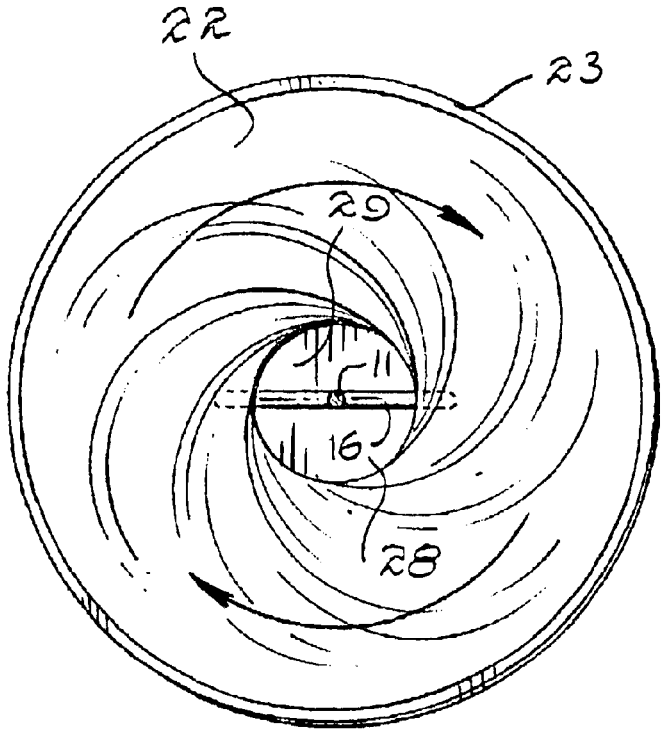

MIXING ROD

Priority Claimed based on Ser. No. 60/374,755 filed Apr. 24, 2002.

BACKGROUND OF THE INVENTION

1. Field of the Invention

The present invention relates to the field of power mixing devices and more particularly to a novel elongated mixing rod having a chuck attachment means at one end for detachably coupling with the chuck of a power drill or the like and having a pair of outwardly projecting lobes at its other end, terminating in rounded corners wherein the rod is integrally formed into a unitary construction providing an elongated shaft with the outwardly projecting lobes.

2. Brief Description of the Prior Art

In the past, it has been the conventional practice to mix such items as paint, aggregate slurry, petroleum products or the like by inserting a paddle or fluted blade into the mixture and rotating the blade by either manual or powered means. The paddle or blade can be raised or lowered into the mixture at the choice of the operator and the paddle or blade may be power rotated or manual.

Difficulties and problems have been encountered when employing such apparatus which stem largely from the fact that the paddle or blades have sharp edges which cut or engage with the internal wall of the container which causes damage to the paddle or blade and which may cause chips or foreign matter to be mixed with the product being stirred. Also, conventional paddles or blades are usually located at a particular level within the container so that mixing relies on fluid flow throughout the interior of the container. However, inadequate mixing often occurs since the blades or paddles are located immediately adjacent the bottom of the container and proper flow for mixing purposes is not achieved. Also, the blade or paddle may readily engage the bottom of the container and the sharp edges will embed or bury therein, causing breakage of the mixing unit itself.

Therefore, a long standing need has existed to provide a novel mixing means which will induce proper fluid flow within the interior of the container so as to insure proper and efficient mixing of the product. The device must be devoid of sharp edges and points which might otherwise engage with the wall of the container causing damage and improper fluid flow.

SUMMARY OF THE INVENTION

Accordingly, the above problems and difficulties are avoided by the present invention which provides a novel mixing rod which is composed of an integral metal construction from a single piece so as to provide a unitary unit having a power chuck engaging means at one end and a stirring means at the opposite end. The stirring means includes a pair of lobes defined by rod segments integral with an elongated shaft, wherein the lobes outwardly project 180° from one another. Each of the respective lobes terminates at its outer ends with rounded corners and a lower segment joins the opposite lobes together. The lobes have a height which insures that a substantial portion of the product being stirred will be engaged by the lobes in order to develop a proper product flow insuring efficient and proper mixture.

Therefore, it is among the primary objects of the present invention to provide a novel rapid mixing device which does not employ sharp blades or edges and which provides a portion for mixing a product adjacent to the bottom of a container.

Another object of the present invention is to provide a rapid product mixing device which is easy to clean and which eliminates "build-up" of material on the mixer means.

Yet another object of the present invention is to provide a drilling rod which will fit in any electric or hand drill so that the device will work in both forward and reverse directions.

A further object resides in providing a mixing rod which is suitable for mixing a multitude of products extending from adhesive materials to cement and further to paint and multiple textured products.

Still a further object is to provide a set of mixing rods wherein a single rod may be selected by the user for mixing a select product from a multitude of products, such as paint, thinset, grout, cement, drywall mud, wall and ceiling textures, epoxies, chemicals or the like.

Still another object resides in providing a mixing rod composed of light-weight steel construction, so that the rod is durable, long-lasting, and incorporates simplicity in its design, allowing for cleaning after a mixing procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 3 is a fragmentary view, in cross-section, of a container having contents being stirred by the mixing rod employing the present invention;

FIG. 4 is a top plan view with the mixing rod in section illustrating swirl of the contents in the container as the mixing rod is rotated.

DESCRIPTION OF PREFERRED EMBODIMENT

Figure 1:
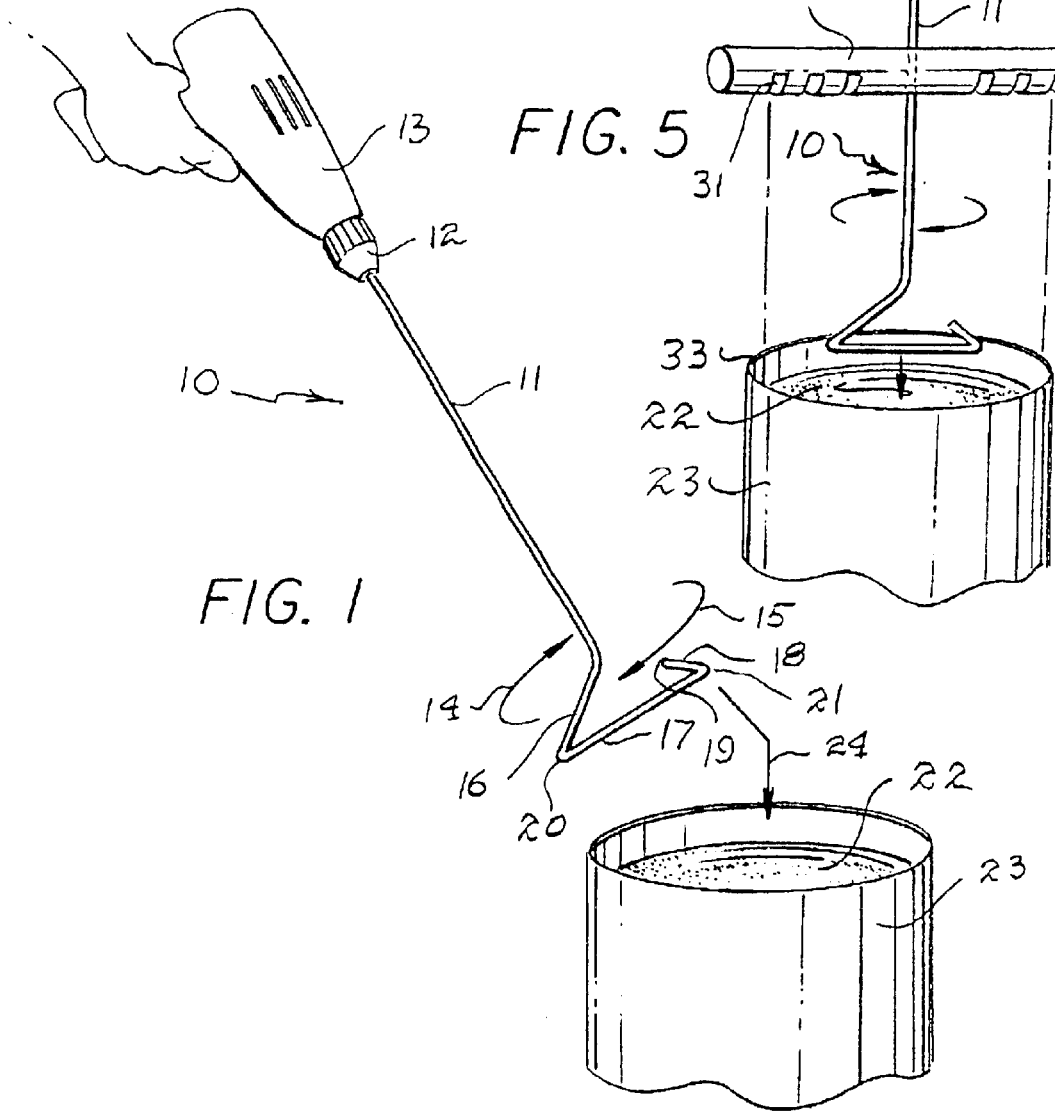
FIG. 1 is a diagrammatic perspective view showing the novel mixing rod employed in a mixing procedure in accordance with the present invention.

Referring to FIG. 1, the novel mixing rod is indicated in the general direction of arrow 10, which includes an elongated shaft 11 having one end detachably connected to a chuck 12 of a drill 13 for powering the mixing rod in a rotary direction as indicated in the direction of arrows 14 and 15. The direction of rotation can be either clockwise or counterclockwise. The mixing end of shaft 11 terminates in folded-over segments defining a mixing or stirring means or head which is composed of a linear angular segment 16 which is laterally bent away from the shaft 11 and further bent under upon itself to define a linear terminating segment 17 which is then bent upwardly to provide an end segment 18 having a distal end 19 in spaced-apart relationship with respect to shaft 11. It is of particular importance that the bends or folds joining the respective segments are rounded, such as at corners 20 and 21. Therefore, it can be seen that the mixing rod 10 is of unitary construction providing a one-piece tool for mixing a product 22 carried in a container 23. The product 22 may be of any composition, density, or material intended to be stirred and thoroughly mixed. The mixing rod is introduced into the center of the contained product 22, as indicated by arrow 24 along the central longitudinal axis of the container.

Figure 2:
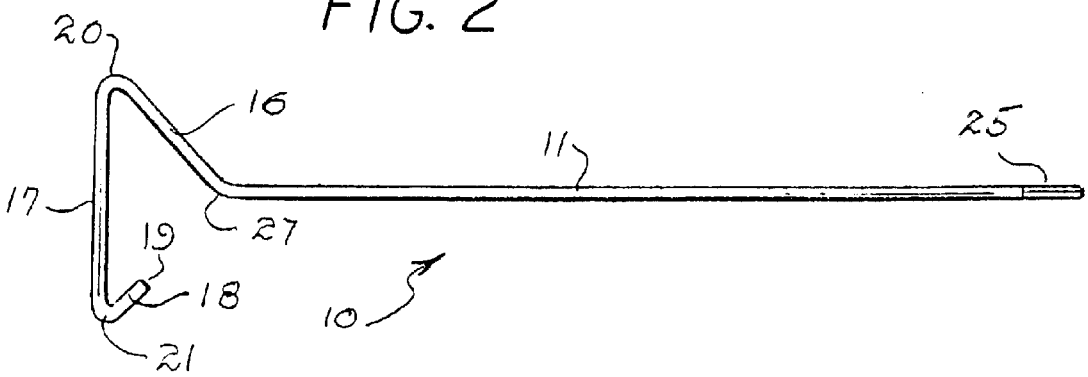
FIG. 2 is a side elevational view of the mixing rod used in FIG. 1.

Referring now in detail to FIG. 2, it can be seen that the shaft 11 is elongated and terminates at one end in a shaped geometric configuration, such as hexagon or square, so as to be removably received within the chuck 12 of drill 13. The attachment end or shaped end is indicated by numeral 25 and is configured to mate with the internal shape of the chuck. Preferably, the mixing rod 10 is composed of a rigid metal, such as stainless steel or the like, and the end opposite to the end 25 terminates in a product 22 engaging mixing head, comprising segments or sections 16, 17 and 18. By folding the segments or sections over upon themselves, greater stirring area is provided so that flat paddles and blades are unnecessary. The rounded corners 20 and 21 are suitable for sliding engagement with the inside wall surface of container 23 in order to clean the walls or to more thoroughly mix the product 22. It is also to be noted that the length of angular segment or section 16 is shorter than the bottom or terminating segment or section 17, while the end segment or section 18 is shorter in length than both segments or sections 16 or 17. It is again emphasized that the mixing rod 10 is of unitary construction so that a one-piece mixing rod is produced from a single length of metal rod and which is bent respectfully at corners 20 and 21 as well as at a fold or corner bend 27.

Referring now in detail to FIG. 3, it can be seen that the mixing rod 10 has been introduced into the product 22 intended to be mixed. The product is contained within the container 23 and the rod is introduced in the center of the contained product. As the rod is rotated either clockwise or, if desired counter-clockwise, in the direction of arrow 40, the product 22 will be moved so as to provide a swirl or central "eye" identified by numeral 28 and as rotation continues, the product flows initially as indicated by numeral 41, by instantly moving the material so as to climb upwardly along the inside surface of the container as the material continues to swirl. The arrows indicated by numeral 42 illustrate gravity influencing the product by returning the product or material to be mixed through the "eye" 28. The rod may be moved anywhere in the interior of the container because the rounded corners 21 and 22 will not impede rotation if engaged with the inside surface of the container 23. Also, the bottom or terminating segment or section 17 may engage with the bottom 29 of the container without causing damage or impeding mixing. The rod is round in cross section along its entire length so that the material being stirred will flow easily about the rod.

In FIG. 4, a top view is illustrated wherein rotation of the rod causes the material 22 to swirl within the confines of the container 23. The "eye" 28 indicates that the materials flow about the "eye" in a cyclone effect.

In actual usage, the friction from the product or material passing or flowing around the bent shaft of the mixing rod causes the contents of the container to be pushed and pulled at the same time. This procedure occurs at many locations within the material mass inside the container wherein the smallest particles or product or material are carried to several different areas to mingle with other particles many times over. This happens in just the first few revolutions of mixing rod rotation. This is a major agitation of the molecules, resulting in an almost violent, forced blending of compatible fluids, chemicals, abrasives, adhesives, media and aggregates. The inventive mixing rod is a revolutionary device that mixes a multitude of products from adhesives to cement and from paint to textures in a fast, easy and thoroughly mixed procedure. The mixing rod is designed to fit in any electric or hand drill at the selection of the user. When the mixing rod is rotated quickly, the mixing rod generates a vortex similar to a cyclone, and this cyclone action rapidly blends the product or material in its path.

Clean-up is easy and convenient and the simplicity of the mixing rod allows for clean-up in seconds. The major features of the inventive mixing rod resides in that the mixing rod mixes almost anything in seconds and provides easy clean-up. No sharp edges, corners or blades are employed and the rod will not cut through plastic pails and will mix product to the bottom and corners of the container.

Figure 5:
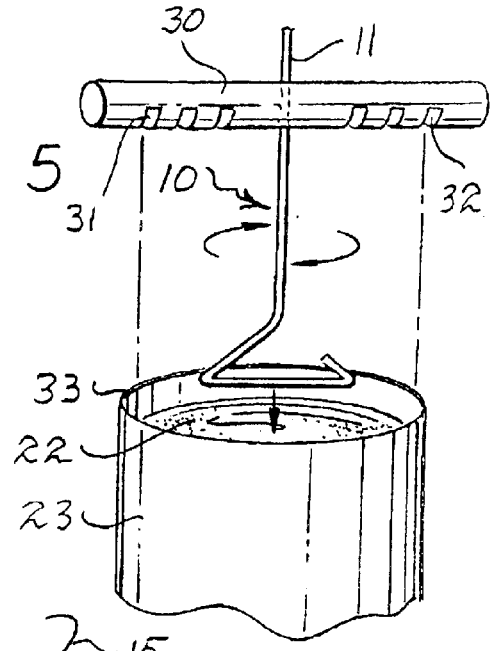
FIG. 5 is a front perspective view of the novel mixing rod employed in combination with a mixing rod support.

Referring now in detail to FIG. 5, an accessory for use with the mixing rod 10 is illustrated by the numeral 30, which provides an elongated member having a plurality of spaced-apart slots, such as slot 31 and slot 32. These slots are intended to be insertably engaged with an edge 33 of the container 23 so that the member 30 provides a stabilizer for the mixing rod. A hole is provided in the middle section of the member 30 so that the end of the rod or shaft 11 may be inserted therethrough so that the mixing sections 16, 17 and 18 can be introduced into the product 22 in the container 23. The member 30 not only stabilizes the mixing rod, but centers the rod so as to be introduced into the product at the center of container 23 along its central longitudinal axis. A plurality of pairs of slots are provided in order to accommodate a variety of container diameters. Therefore, for the diameter of container 23, slots 31 and 32 would be employed.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A mixing rod comprising:

an elongated rigid shaft having an attachment end and a mixing end integrally joined together by a midsection;

said mixing end includes a linear angular segment bent outwardly from said shaft to project laterally from said shaft;

said mixing end further having a linear terminating segment integrally connected with said angular segment and bent inwardly under said angular segment in fixed, spaced-apart relationship to said angular segment and further projects past said shaft to terminate in an end segment;

said end segment being integral with said terminating segment and incorporating a reverse curve to project inwardly towards said angular segment in fixed, spaced-apart relationship therewith;

said shaft, said angular segment, said terminating segment and said end segment constitute a single piece construction with said segments being bent or folded over to provide a substantially triangle configuration in side elevational view;

said attachment end of said shaft is integral therewith and defines a geometric shape including a square or a hexagon;

rounded connection portions joining said angular segment with said terminating segment and joining said terminating segment with said end segment;

a can having a circular top edge leading into an interior of said can for insertably receiving said mixing shaft;

an elongated member having a series of spaced-apart slots with a pair of spaced-apart end slots for receiving said top edge; and a central passageway midway between said pair of end slots for rotatably carrying said shaft.

2. A mixing rod comprising:

an elongated rigid rod having a central longitudinal axis and an attachment end and a mixing end integrally joined together by an elongated midsection;

said mixing end includes a linear side segment bent outwardly from said rod at an angle with respect to said central longitudinal axis to project laterally from said rod;

said mixing end further having a linear terminating segment integrally connected with said linear side segment and bent inwardly toward said central longitudinal axis under said linear side segment in fixed, spaced-apart relationship to said linear side segment and further projects past said rod central longitudinal axis to terminate in an end segment;

said end segment being integral with said terminating segment and incorporating a reverse curve to project inwardly toward said central longitudinal axis and said linear side segment in fixed, spaced-apart relationship therewith;

said rod, said linear side segment, said terminating segment and said end segment constitute a single piece construction with said linear side segment, said terminating segment and said end segment being bent or folded over to provide a substantially triangle configuration in side elevational view;

said attachment end of said rod is integral therewith and defines a geometric shape including a square or a hexagon;

rounded connection portions joining said linear side segment with said terminating segment and joining said terminating segment with said end segment;

a container having a circular top edge leading into an interior storage area of said container for holding a product to be mixed and for insertably receiving said mixing rod;

an elongated member having a series of spaced-apart slots including a pair of spaced-apart end slots for receiving said top edge; and a central passageway midway between said pair of end slots for rotatably receiving said rod.

* * * * *